US006068040A

United States Patent [19]

Magro et al.

[11] Patent Number: 6,068,040

[45] Date of Patent: May 30, 2000

[54] SLAT EDGE RETAINER FOR OVERHEAD ROLLING DOORS

[75] Inventors: Sebastian Magro, North Stonybrook; Felice P. DeGiovanni, Middle Village, both of N.Y.

[73] Assignee: Alpine Overhead Doors, Inc., Brooklyn, N.Y.

[21] Appl. No.: 09/122,551

[22] Filed: Jul. 24, 1998

[51] Int. Cl.[7] ..... E06B 9/08

[52] U.S. Cl. ..... 160/133; 160/41; 160/290.1

[58] Field of Search ..... 160/113, 117, 160/118, 207, 209, 133, 41, 290.1, 269, 273.1, 271, 265

[56] References Cited

U.S. PATENT DOCUMENTS

| | | | |
|---|---|---|---|
| 949,789 | 2/1910 | Wilson | 160/133 |
| 1,912,817 | 6/1933 | Bauer | 160/133 |
| 1,918,415 | 7/1933 | Miller | 160/133 |
| 2,419,107 | 4/1947 | Baldwin | 160/133 |
| 2,572,257 | 10/1951 | Gerner et al. | 160/133 |
| 3,076,499 | 2/1963 | Zoll et al. | 160/133 |
| 3,489,200 | 1/1970 | Recchione | 160/133 |
| 3,734,161 | 5/1973 | Pierce | 160/133 |
| 4,601,320 | 7/1986 | Taylor | 160/133 X |
| 5,253,694 | 10/1993 | Bernardo | 160/133 |
| 5,482,104 | 1/1996 | Lichy | 160/273.1 |
| 5,657,805 | 8/1997 | Magro | 160/133 |
| 5,839,493 | 11/1998 | Quasius | 160/133 |

*Primary Examiner*—Daniel P. Stodola
*Assistant Examiner*—Bruce A. Lev
*Attorney, Agent, or Firm*—Lackenbach Siegel Marzullo Aronson & Greenspan, P.C.

[57] ABSTRACT

An edge retainer for a slat of an overhead rolling door is formed of a plurality of elongate substantially horizontal slats each a which defines a slat plane and which has two opposing substantially parallel longitudinal edges in the lateral edge at each longitudinal end. Adjacent slats are hingedly interlocked at their longitudinal edges to enable the door to assume a rolled condition when the door is open and substantially planar when the door is closed. The retainer includes first and second members having mounting portions the lateral edge of the slat and are secured to opposite surfaces of the slat to receive at least a portion of the lateral edge sandwiched therebetween. An end lock is integrally formed with one of the mounting portions and extends from one side of the slat to the other side of the slat. A wind lock is integrally formed with the other mounting portion and extends from the other side thereof to the first side of the slot. In this way, longitudinally outwardly directed forces on at least one of the wind lock and end lock promotes the mounting portions to press against and grip the sandwiched portion of the lateral edge of the slot between the mounting portions.

30 Claims, 6 Drawing Sheets

SLAT EDGE RETAINER FOR OVERHEAD ROLLING DOORS

BACKGROUND OF THE INVENTION

1. Field of the Invention

The invention generally relates to wind-resistant overhead rolling doors, and, more specifically, such a overhead rolling door which has an improved retainer for securing the edges of the slats making up the door and providing improved wind lock protection.

2. Description of the Prior Art

Closure devices for protecting openings in building structures, such as doors and windows, are frequently relied upon not only to provide security for the building structure by preventing unauthorized access to the structure, but are frequently also relied upon to protect the structure from severe natural climatic conditions. To the extent that doors and windows are made of glass, these are particularly susceptible to certain atmospheric conditions. Glass, which is frequently used to close openings in building structures, is not only susceptible to damaged flying debris during such adverse climatic conditions, but can also be destroyed as a result of dynamic and/or static air pressure differentials on the two sides of the windows, doors, or the like. As a result of the dangers posed by these natural climatic conditions, a number of states and local governments have enacted rules and regulations in order to prevent or minimize damage. The State of Florida, for example, has enacted such regulations and building codes due to the frequent occurrences of hurricanes in a number of counties in Florida, such as Dade and Broward Counties.

One approach to reducing the problem has been the use of shutters which are hingedly mounted on each side of the opening of the structure. However, such shutters, to be effective, have to be made of heavy materials such as steel, and are not conducive for automatic operation and are relatively expensive. Rolling, slatted doors and shades have also been used. These are typically rolled up in a coil at the top of the opening and unrolled to cover the entire opening exteriorly of the glass windows and doors. While such rolling closures have been effective to prevent impact by flying debris, they typically flex or bend when subjected to positive or negative pressures on the outside of the structure. However, such bending or flexing of the slats outside of the plane of the building structure effectively shortens the lengths of these slats by moving the ends inwardly, particularly on the sides and on the bottom of the door. While some known designs have attempted to limit the lateral inward movements of the ends of the slats, to thereby prevent excessive bowing or flexing of the slats outside the plane of the rolling closure, the effectiveness of the design depends, to a great extent, on the integrity and strength of the connection between the lateral ends of the slats and the end or edge retainers mounted on the slats. Such retainers are designed to be guided within guide channels provided in the vertical side portions of the frame of the door. One example of such a design is illustrated in U.S. Pat. No. 5,657,805 for a wind-resistant overhead closure. This patent is primarily concerned with minimizing the flexing or bending of the lowermost or bottom slat or slats of the door. However, the retainer, of the type shown in FIG. 7 of the patent, includes a single flat mounting portion which is attached to the lateral edge of a slat. When such flat mounting portion is attached to the flat portion of the slat by means of a suitable fastener, such as a rivet, it will be clear that the strength of the connection will be a function of the single shear strength of the rivet or rivets used to make the connection. Also, because the retainer members are generally mounted for free movements within the guide channels, there are provided clearances between the retainer and the vertical side frame members, severe wind loads, causing the slats to flex or bend a substantial amount may cause the retainers to be dislodged from the guide channels, severely compromising the ability of the door to protect the enclosure.

In U.S. Pat. No. 1,918,415, a combined bracket and guide for rolling steel doors is disclosed, an end lock is provided which closely abuts the rolled edges of the slats to prevent the plates from moving longitudinally in relation to each other, and also includes an L-shaped bracket provided at spaced intervals on selected slats arranged to engage behind one of the legs forming the guide channel in order to maintain the position of the door in relation to the guide channels. However, the bracket which forms the wind lock is a simple L-shaped bracket secured by means of rivets to one side or planar portion of the slat. The strength of the connection of the slat is, as with the previously described design, a function of the single sheer force of the rivet or rivets used. Also, any forces applied to the wind lock in the design of this patent act to separate the wind lock from the slat, placing the rivet or rivets in tension, creating another possible mode for failure. A similar construction is disclosed in U.S. Pat. No. 3,076,499 which discloses a rolling metal door. A sealing and guiding structure for a door is disclosed in U.S. Pat. No. 3,489,200, which also discloses a similar construction. Wind locks in the form of bent brackets mounted on one side of selected slats by means of bolts are disclosed in U.S. Pat. No. 3,734,161, for a door construction.

In U.S. Pat. No. 5,253,694, a rolling shutter slat and retainer is disclosed in which the retainer mounting portion is received between two spaced panels or plates forming a single slat. While such construction strengthens the connection between the retainer and the slat to withstand double the sheer forces, the slat disclosed is non-conventional, not in common use and substantially more expensive than single panel, conventional slats. Also, application of significant forces on the retainer would appear to cause the retainer to pivot or rotate in relation to the slats about the rivets, tending to separate the two panels forming the slat, instead of applying gripping or holding forces thereto.

SUMMARY OF THE INVENTION

Accordingly, it is an object of the present invention to provide edge retainers for slats of an overhead rolling door which do not have the disadvantages inherent in such prior art edge retainers.

It is another object of the present invention to provide an edge retainer which is simple in construction and economical to manufacture.

It is still another object of the present invention to provide an edge retainer of the type under discussion which can be readily and conveniently mounted on conventional flat, single panel slats of rolling steel doors, both at the factory and in the field.

It is yet another object of the present invention to provide an edge retainer as in the previous objects which enhances the integrity of the connection between the edge retainers and the associated slats by substantially doubling the shear strength for the same or equal number of fasteners, such as rivets.

It is a further object of the present invention to provide an edge retainer as suggested in the previous objects which provides a clamping or gripping action on the slat to which the retainer is attached, which increases the gripping or clamping forces as the wind loads on the slats are increased.

It is still a further object of the present invention to provide an edge retainer which incorporates the advantages of the aforementioned objects and which is further provided with wind lock and end lock configurations that minimize the risk of the retainers from being pulled out or dislodged from the guide channels in which they are mounted as a result of rotation of the edge retainers within such channels as a result of excessive bending or flexing of the slats.

It is yet a further object of the present invention to provide an edge retainer of the type under discussion with also minimizes the amount of rotation of an edge retainer within an associated guide channel in which it is mounted for movement as a result of excessive wind loads and flexing of the associated slats, thereby minimizing undesired dislodgment of the edge retainers from such guide channels.

It is an additional object of the present invention to provide an improved wind-resistant overhead rolling door which incorporates the improved edge retainers in accordance with the present invention.

In order to achieve the above objects, as well as others which will become apparent hereinafter, an edge retainer in accordance with the present invention for a slat of an overhead rolling door formed of a plurality of elongate substantially horizontal slats, each defining a slat plane, and having two opposing substantially parallel longitudinal edges and a lateral edge at each longitudinal end, in which adjacent slats are hingedly interlocked at their longitudinal edges to enable the door to assume a rolled condition when the door is open and a substantially planar condition when the door is closed. The retainer of the invention comprises first and second members having mounting portions bridging a lateral edge of a slat and being secured to opposite sides or surfaces of the slat to receive at least a portion of the lateral slot sandwiched therebetween. An end lock is integrally formed with one of said mounting portions and extends from one side of the slat to the other side thereof. A wind lock is integrally formed with the other of said mounting portions and extends from said other side thereof to the first side of the slat. In this manner, longitudinally outwardly directed forces on at least one of the wind lock and end lock promotes said mounting portions to press against and grip said sandwiched portion of said lateral edge of the slat between said mounting portions.

A wind-resistant overhead closure in accordance with the present invention serves to selectively open and close a generally rectangular opening in a wall of a building structure. The closure comprises a frame dimensioned to conform to the wall opening and includes an upper horizontal portion and spaced vertical side portions. A rolling door extends between said side portions and having a plurality of elongate substantially horizontal slats each defining a slat plane and having two opposing substantially parallel longitudinal edges and a lateral edge at each longitudinal end. Adjacent slats are hingedly interlocked at their longitudinal edges to enable the door to assuming a rolled condition when the door is open and a substantially planar condition when the door is closed. Edge retainers are mounted on selected slats and cooperate with associated side portions. Each retainer comprises first and second members having mounting portions bridging a lateral edge of a slat and being secured to opposite surfaces of the slat to receive at least a portion of the lateral edge sandwiched therebetween. An end lock is integrally formed with one of said mounting portions and extends from one side of the slat to the other side thereof. A wind lock is integrally formed with the other of said mounting portions and extends from said other side thereof to the first side of the slat. In this way, longitudinally outwardly directed forces on at least one of said wind lock and end lock promote said mounting forces to press against and grip said sandwiched portion of said lateral edge of the slat between said mounting portions.

The constructions in accordance with the present invention not only substantially increase the integrity of the connection between the slats and the retainers mounted at the lateral edges thereof, by substantially doubling the shear strength for the same or equal number of fasteners, such as rivets, but engagement of the wind locks as a result of the actions of wind loads promotes the connection between the retainer and the associated slat by the gripping or clamping action of the flat mounting portions on that portion of the slat which is sandwiched therebetween.

A BRIEF DESCRIPTION OF THE DRAWINGS

These and other objects, features and characteristics of the present invention will be more fully apparent, understood and appreciated from the ensuing detailed description, when read with reference to the various figures of the accompanying drawings, wherein.

DESCRIPTION OF THE PREFERRED EMBODIMENTS

Figure 1:
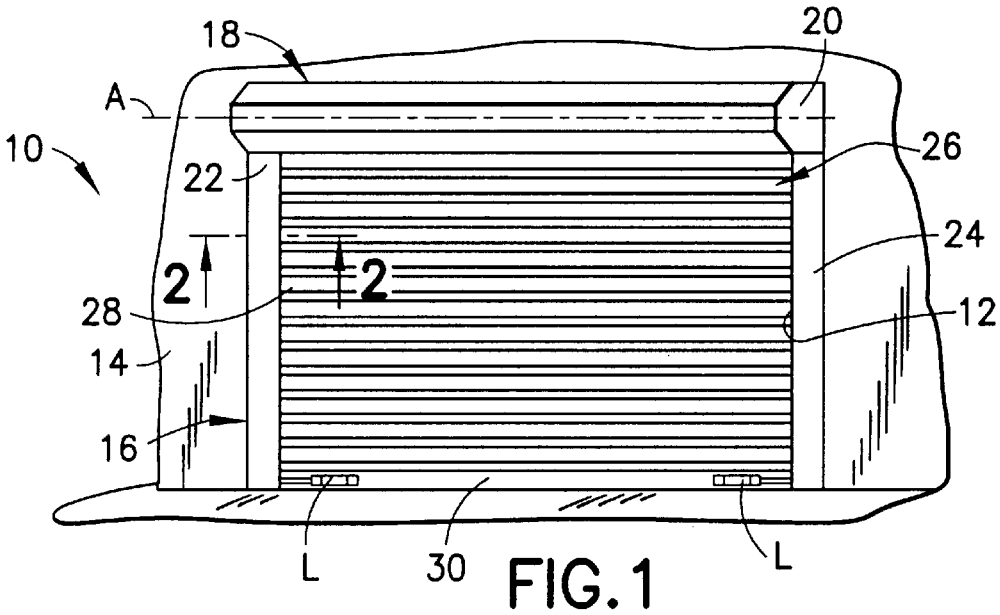
FIG. 1 is a front elevational view of a wind-resistant overhead door in accordance with the present invention, shown in a building structure.

The present invention will now be more specifically described with relation to the figures, in which identical or similar parts are designated by the same reference numeral throughout. FIG. 1 illustrates an overhead door 10 which incorporates the features of the present invention. While an overhead wind-resistant door will be described to illustrate the invention, it will be clear from the description that follows that the same features, designs and features described in connection with a closure in the form of an overhead door 10 can equally be used in connection with any closures for windows or other generally rectangular openings in building structures.

Figure 2:
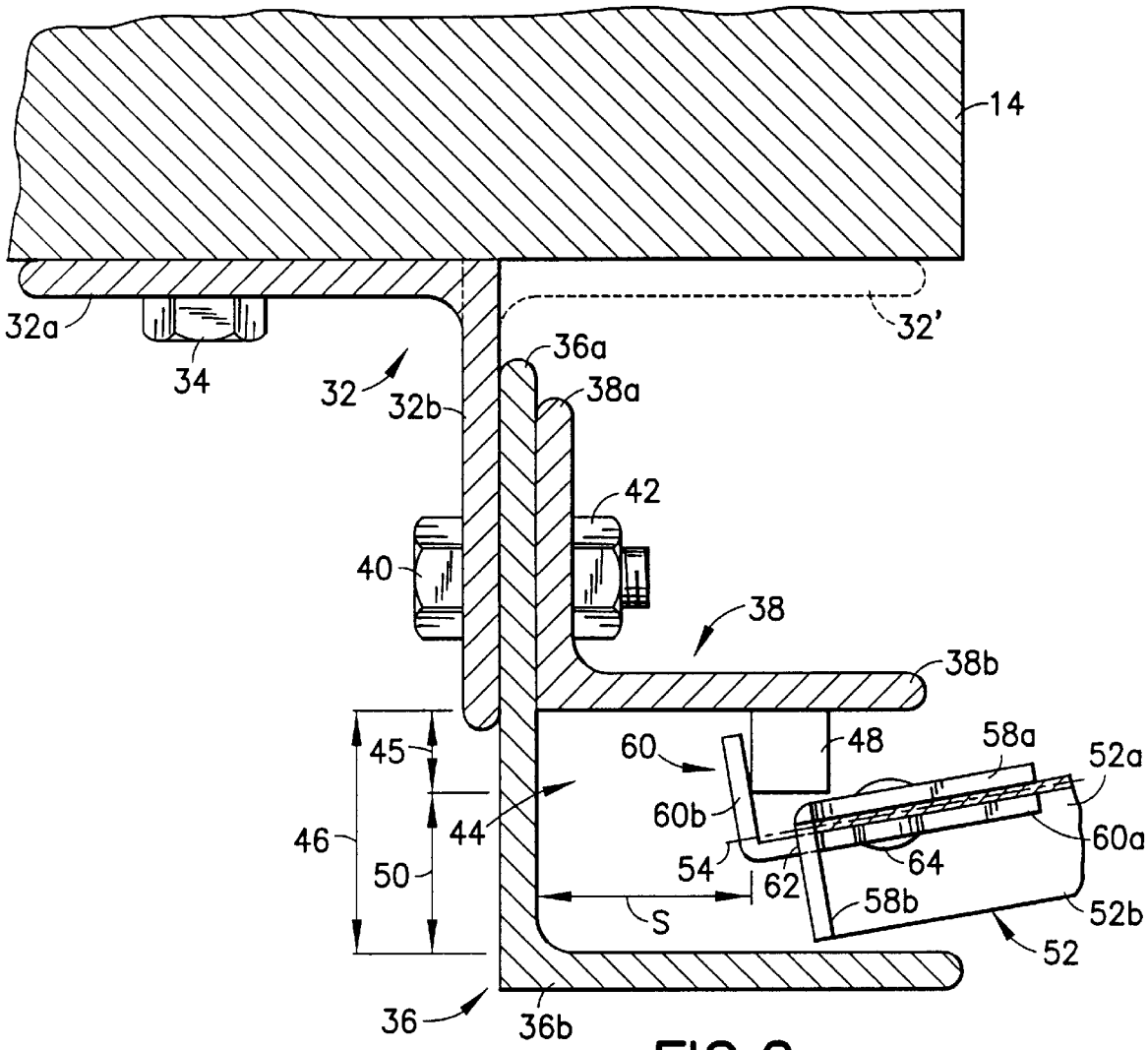
FIG. 2 is an enlarged cross sectional view taken along line 2—2 in FIG. 1, illustrating the details of one vertical side portion of the frame which forms a guide channel for the improved edge retainer and showing a condition of the wind lock when it is engaged due to the flexing of the rolling door slat on which it is mounted as a result of wind loads.

In FIG. 1 the overhead door 10 is used to open and close a generally rectangular opening 12 in a wall 14 of the building structure. The overhead door 10 includes a frame generally designated by the reference numeral 16, which defines a plane P (FIG. 6) and is dimensioned to conform to the wall opening. The frame 16 includes an upper horizontal portion 18. Typically, the upper horizontal portion 18 includes an enclosure or hood 20 which houses a rotatably mounted horizontal shaft (not shown), as well known to those skilled in the art. The frame 16 also includes spaced vertical side portions 22, 24 which support and guide a rolling member or door 26. The rolling door 26 extends between the side portions 22, 24 and is typically formed of a plurality of intermediate closure portions in the form of articulated intermediate slats 28. An endmost closure portion in the form of an endmost slat 30 is arranged at a point most remote from the enclosure or hood 20 when the rolling door 26 is in a closed position, as shown in FIG. 2. The door may be locked in the closed position as shown by conventional locks L.

Referring to FIG. 2, there is shown in enlarged cross sectional view of the left vertical side portion 22, showing the manner in which the lateral edge of the rolling door interacts with the frame under wind load conditions. The frame side portion 22 includes an angle iron 32 which has one flange 32*a* secured to the wall 14 by means of a conventional bolt 34 and flange 32*b* which projects from the wall in a substantially perpendicular direction, as shown. The second angle iron 36 is arranged with its flange 36*a* in abutment against the flange 32*b*, while a smaller angle iron 38 has its flange 38*a* in abutment against the larger flange 36*a*. A bolt 40 and nut 42 may be used to rigidly secure the flanges 32*b*, 36*a* and 38*a* to each other to create a substantially vertical guide channel 44 between spaced flanges 36*b* and 38*b*, as shown. The guide channel is generally open along the inward direction facing the opposing frame side portion 24 for receiving the lateral edges of the slats forming the rolling door 26. While the nominal distance between the flanges 36*b* and 38*b* is 46, there is provided suitable stop a distance "s" from the flange 36*a* which effectively reduces the spacing between the flanges 36*b* and 38*b* to the distance 50 in the vicinity of the stop 48. It will be clear, therefore, that any elements the dimensions of which are less than 50 can move past the stop 48 and become dislodged, while any elements that have dimensions greater than 50 cannot do so and must remain within the guide channel 44 between the flange 36*a* and the stop 48.

The rolling door 26 is formed of a plurality of slats 52 which may be constructed in any conventional way and may be formed as shown in the patents identified in the Background of the Invention section. Typically, adjacent slats 52 are provided with rolled up interlocking longitudinal edges to provide a hinge element between the slats which allows the rolling door to assume a rolled position when the door is open and a substantially planar condition when the door is closed. In FIG. 2, the slat 52 has a substantially flat slat face 52*a* which defines a slat plane 54 and a generally transverse bent portion 52*b* which supports one of the rolled edges forming the hinge.

Figure 3:
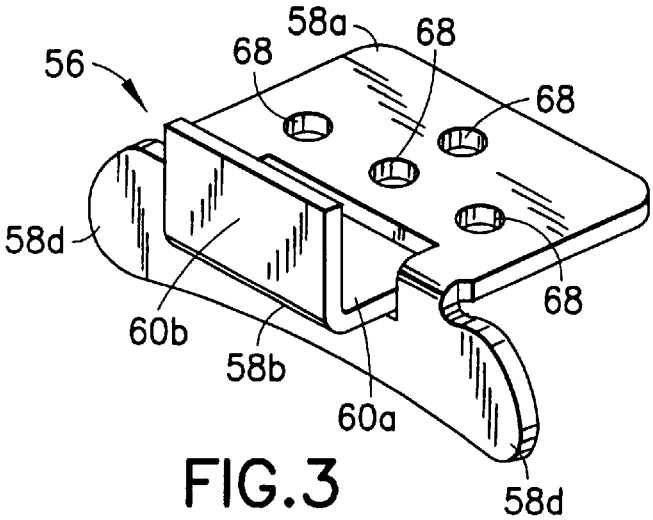
FIG. 3 is a perspective view of an edge retainer in accordance with the present invention.
Figure 3A:
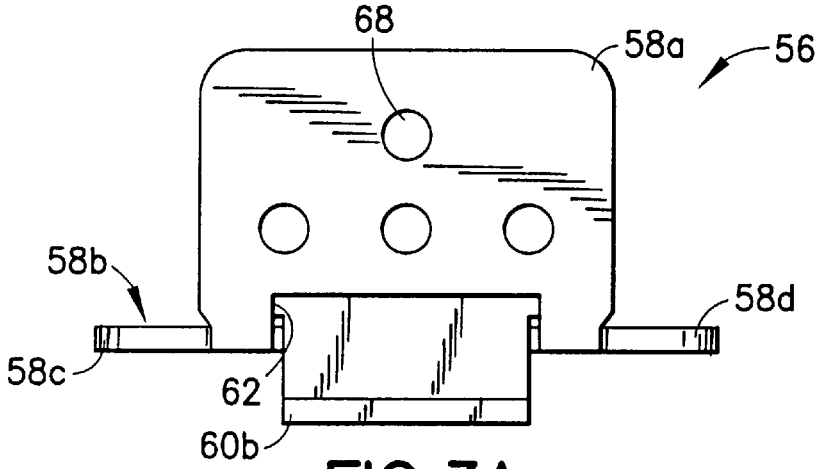
FIG. 3A is a top elevational view of the retainer shown in FIG. 3.
Figure 3B:
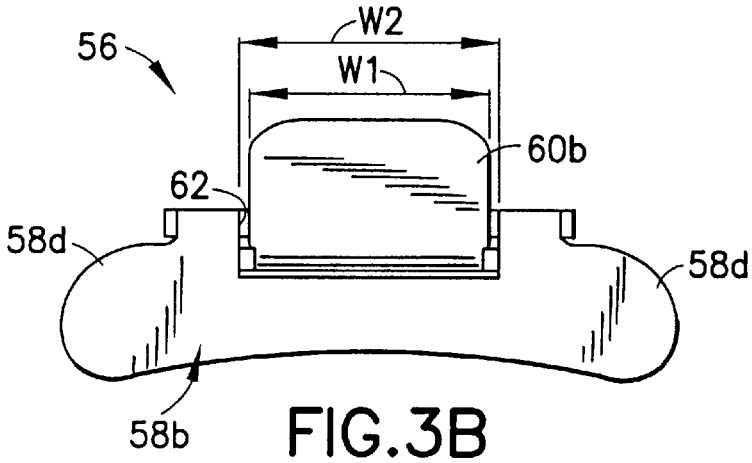
FIG. 3B is a front elevational view of the edge retainer shown in FIG. 3.

An edge retainer, in accordance with the present invention, is generally designated by the reference numeral 56 and it is formed of an end lock member 58 which has an end lock support portion 58*a* bridging a lateral edge of the slat, as shown, and a second wind lock member 60 which has a wind lock support portion 60*a* and a wind lock portion 60*b* which bridges the lateral edge of the slat face 52*a*. Both support portions 58*a* and 60*a* are secured to opposite sides or surfaces of the slat face 52*a* to receive at least a portion of the lateral edge sandwiched therebetween, as shown in FIG. 2. The end lock 58*b* is integrally formed with the end lock support portion 58*a* and extends from one side of the slat face 52*a* to the other side thereof. A wind lock 60*b* is integrally formed with the wind lock support portion 60*a* and extends from the other side of the slat face 52*a* and slat plane 54 to the reverse side. The support portions 58*a*, 60*a* are secured to opposite surfaces of the slat face 52*a* by any suitable fastener means, such as rivet 64, to receive and securely retain that portion of the slat face 52*a* which is received or sandwiched between the two support portions. Two or more rivets may be used. In order to superimpose the support portions 58*a*, 60*a* on opposite sides or surfaces of the edge of the slat face 52*a*, there is provided a slot 62 within one of the support portions. As best shown in FIG. 3B, the wind lock 60*b* has a width dimension W1 which is less than the width W2 of the slot 62 so that the wind lock 60*b* can pass through the slot in order to bring the two support portions 58*a*, 60*a* into substantial opposition to each other as shown. Referring specifically to FIG. 3D, wind lock support portion 60*a* is provided lateral protuberances 66 which define a width W3 which is greater than both the width W1 of the wind lock 60*d* as well as the width W2 of the slot 62. Thus, after the wind lock 60*b* is passed through the slot 62 the lateral protuberances 66 abut against the end lock 58*b* to prevent further movement of the wind lock support portion 60*a* through the slot 62, and this assures desired alignment of the support portions 58*a*, 60*a*, and particularly the alignment of the holes 68 in the support portions for the rivets or other fasteners.

The end lock 58*b* includes lateral ears 58*d* as shown, for example, in FIG. 3B, the end lock 58*b* generally being configured or shaped to overlap the rolled up portions of adjacent slats to provide the traditional function of such end locks, namely, to prevent relative lateral shifting of slats relative to each other.

As best shown in FIG. 3D, the area defined by the wind lock support portion 60*a* need not be the same area defined by the end lock support portion 58*a*, or vice versa. While these support portions may be the same size, on opposite sides of the edge of the slat face 52*a*, in the embodiment illustrated the wind lock support portion 60*a* is almost one half of the area of the area of the end lock support portion 58*a*, having been cut, by any suitable means, such as a laser, along the contour 72. As a result of the superior performance of the edge retainer of the present invention, support portions may be reduced in size while still providing the reliable connection to the edges of the associated slats. When the wind lock support portion 60*a* is reduced in size as shown, a saving in metal equivalent to the shaded area 74 can be made, thus reducing the cost of the retainer, as well as reducing shipping costs and storage. Also, the different sizes of the support portions help to distinguish between the wind lock and the end lock, to assure proper installation of the retainer in the field.

Figure 3C:
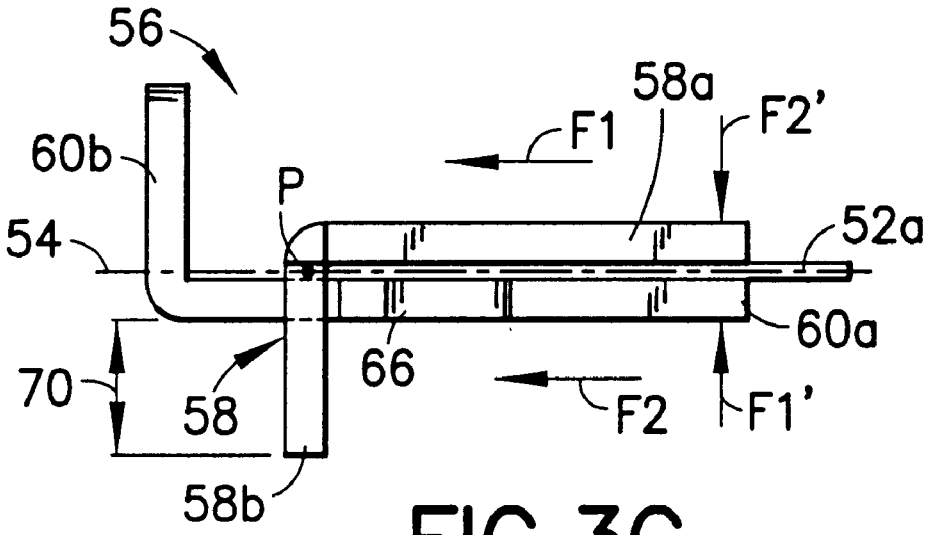
FIG. 3C is a side elevational view of the edge retainer shown in FIG. 3, showing the flat mounting portions forming the edge retainer abutting against or contacting opposing sides or surfaces of a slat which is sandwiched between the mounting portions.
Figure 3D:
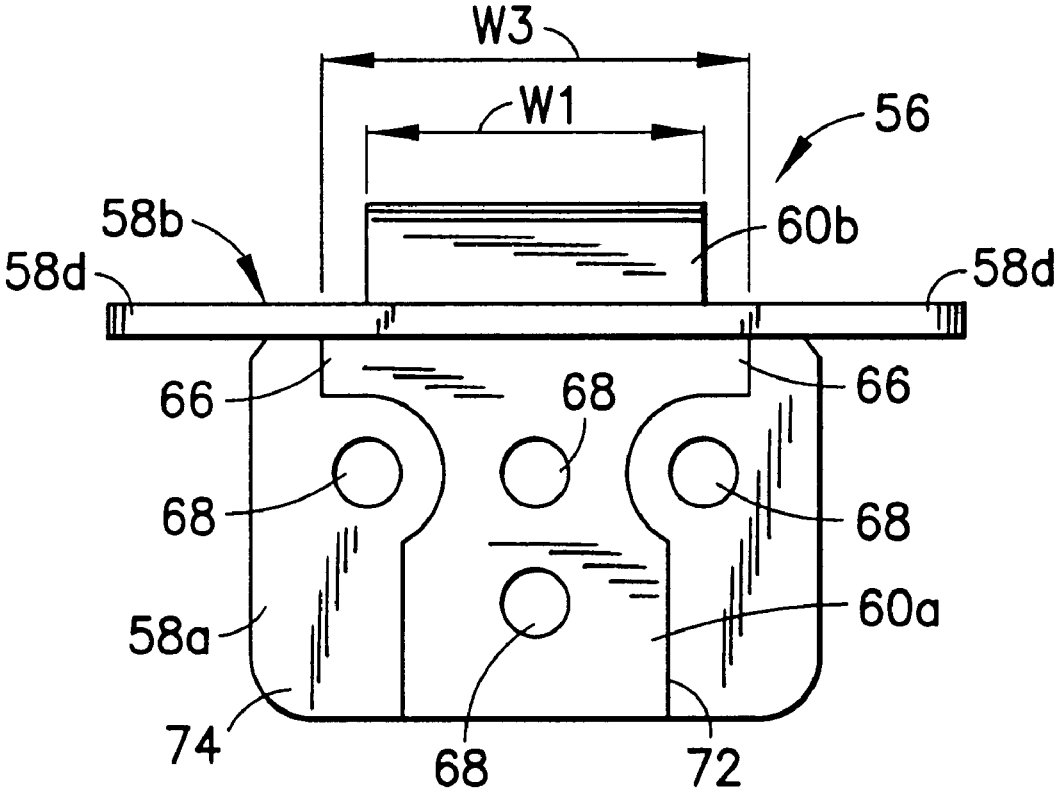
FIG. 3D is a bottom elevational view of the edge retainer shown in FIG. 3.

Referring specifically to FIG. 3C, the end lock and wind lock members are shown in their positions engaging, from opposite sides, an edge portion of the slat face 52*a*, straddling or bridging the edge of the slat at a position P. Movements of the support portions 58*a*, 60*a* relative to the slat face 52*a* edge and to each other are prevented, in part, because of the one or more rivets 64 that extend through the support portions and the slat face. Additionally, the lateral protuberances 66 further prevent relative movements of the wind lock support portion 60*a* towards the left relative to the end lock support portion 58*a*, as viewed in FIG. 3C. An important feature of the present invention is that a force F1 applied to the wind lock 60*b*, towards to the left as viewed in FIG. 3C, will have a tendency to cause the integrally formed wind lock 60*a* to rotate in a substantially counterclockwise direction about pivot axis point P into a more forceful abutment against the lower surface of the slat face 52*a* as view in FIG. 3C. Similarly, the application of an outwardly directed force F2 applied to the end lock 58*b* will cause the integrally formed end lock support portion 58*a* to rotate in a substantially clockwise direction about the axis point P, further pressing against the upper surface of the slat face 52*a* as viewed in FIG. 3C. It will be clear, therefore, that the application of one or both of the outwardly directed forces F1, F2 as shown will cause one or both of the wind lock or end lock to press against and grip the sandwiched portion of the lateral edge of the slat face 52*a* between the mounting portion 58*a*, 60*a* as shown. It will be clear, therefore, that the construction of the edge retainer in accordance with the present invention significantly enhances the integrity of the connection between the retainer and the slat face to which it is connected in two separate and distinct ways. First, each fastener or rivet that extends through the holes 68 of the support portions and through corresponding holes in the slat face 52*a* provides a double shear zone, at each interface between a support portion and the slat face 52*a*. In essence, any rivet 64 extending through the support portions as shown in FIG. 2 has two planes that are in shear when forces F1 and F2 are applied to the end lock 58*b* and wind lock 60*b*. Each rivet, therefore, must essentially fail twice in shear before the slat face 52*a* can be removed from between the abutting supporting portions. Additionally, unlike most known prior constructions, the design of the wind lock and end lock which causes these to bridge the edge of the slat face, to extend from one side to the other side thereof, causes the support portions 58*a*, 60*a* to more forcefully abut and grip the edge of the slat face, not unlike the action of scissors when the handles are squeezed together, bringing the blades on the opposite side of the pivot point together into cutting positions. Therefore, unlike in most prior art constructions, instead of trying to separate or lift from the slat face when forces are applied to the wind lock, the opposite effect is achieved here, which grips the slat face more vigorously, with attendant increased friction between the support portions and the slat face.

Figure 4:
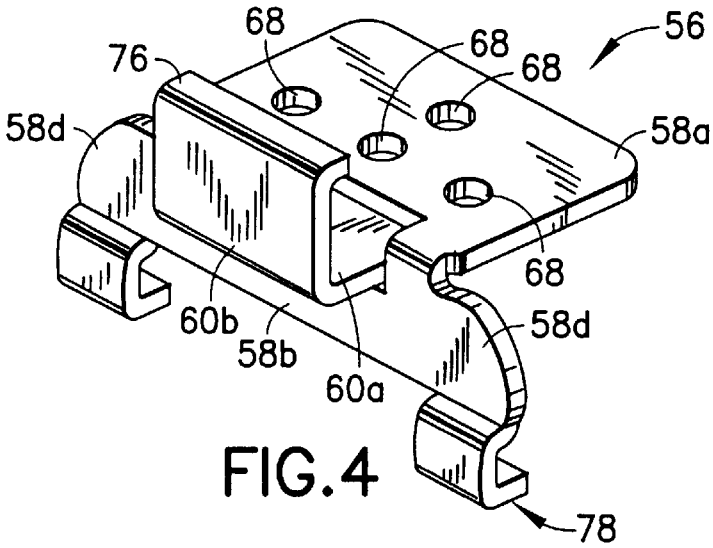
FIG. 4 is a perspective view similar to FIG. 3, but showing another embodiment of an edge retainer in accordance with the invention.
Figure 4A:
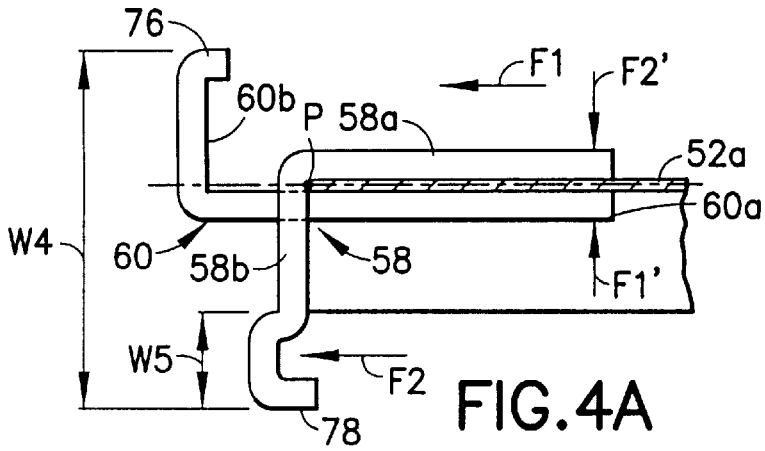
FIG. 4A is similar to FIG. 3C, but illustrating a modified edge retainer shown in FIG. 4.
Figure 5:
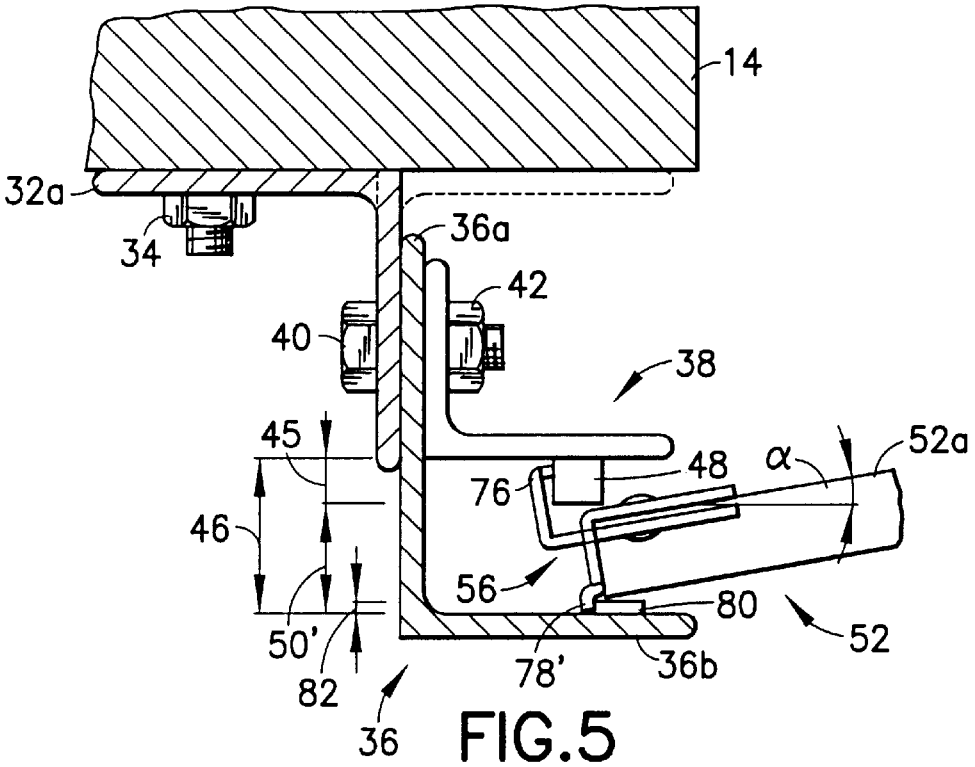
FIG. 5 is similar to FIG. 2, but illustrating still another embodiment of the edge retainer of the invention.

In FIGS. 4 and 4A, a modified edge retainer is shown which is very similar to the edge retainer described in FIGS. 3D. However, in this modified design, the wind lock 60*b* is provided with an L-shaped gripping hook portion 76 inwardly directly towards and substantially parallel to the associated wind lock support portion 60*a*. The end lock 58*b* is provided, at each ear 58*d*, with a U-shaped hook gripping portion 78 as shown. The dimension of the hook shaped gripping portion 78 along the direction of the plane of the end lock 58*b*, is shown in FIG. 4A to be W5, this dimension increasing the dimension 70 of the configuration shown in FIG. 3C to a greater dimension W4. Referring to FIG. 5, a slightly modified version of the edge retainer is shown in FIG. 4 when captured within a guide channel of a frame side portion. In FIG. 5, the slat 52 is shown to have flexed or bent to a degree which results in the lateral edge portion of the slat to have deflected an angle $\alpha$ from the initial undeflected position. In this condition, it is noted that the L-shaped hook gripping portion 76 has engaged the stop 48 while a modified hook portion 78' has engaged a auxiliary stop 80 mounted on the flange portion 36*b*. With the additional stop 80 having a height of approximately 82, the inwardly directed opening is effectively reduced to 50'. Particularly with the addition of the supplemental stop 80, and the hook portion 76, 78', it is more unlikely that the edge retainer will move out from the guide channel 44 as this would require substantial deformation of either one or both of the wind lock 60*b* and/or the end lock 58*b* in order to be able to dislodge the edge retainer.

Figure 6:
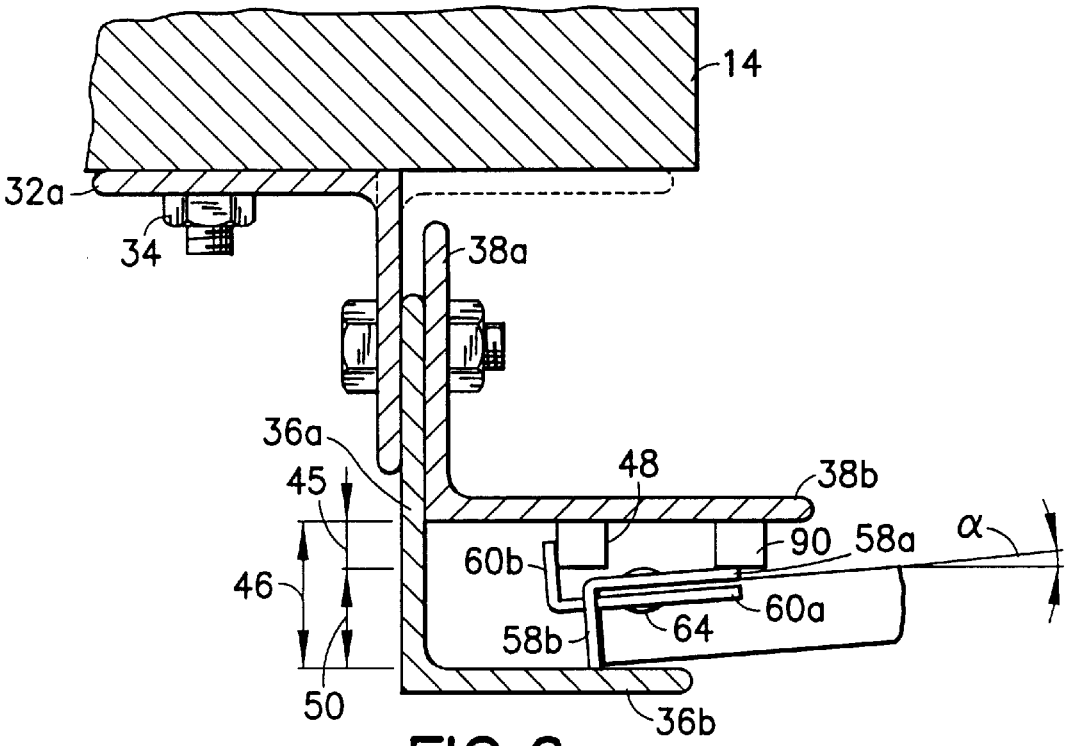
FIG. 6 is a view similar to FIG. 2, but showing an additional member which interacts with the edge retainer for limiting the amount of rotation or pivoting action within the guide channel as a result of enhanced wind loads and attendant flexing or bending of the slats on which the edge retainers are mounted.

In FIG. 6, a view similar to FIG. 2 is shown, in which a pivoting or rotation limiting member 90 is shown, also mounted on the flange 38*b* but inwardly displaced from the stop 48. It will be evident that excessive wind loads on the slats of the rolling door will cause the edge retainer to rotate or pivot in a substantially counterclockwise position to assume an angle $\alpha$ which is a function of the amount of deflection/deformation of the slats. However, since excessive rotation and pivoting of the edge retainer within the guide channel may result in the wind lock 60*b* slipping under and passing the stop 48 as well as the end lock 58*b* overcoming the friction with the flange portion 36*b* to ultimately dislodge the edge retainer 56 from the guide channel 44, an additional protuberance 90 in the form of a bar mounted on the flange portion 38*b* is arranged to engage the edge retainer once the predetermined angle $\alpha$ has been reached to prevent further rotation or pivoting of the edge retainer.

Figure 7:
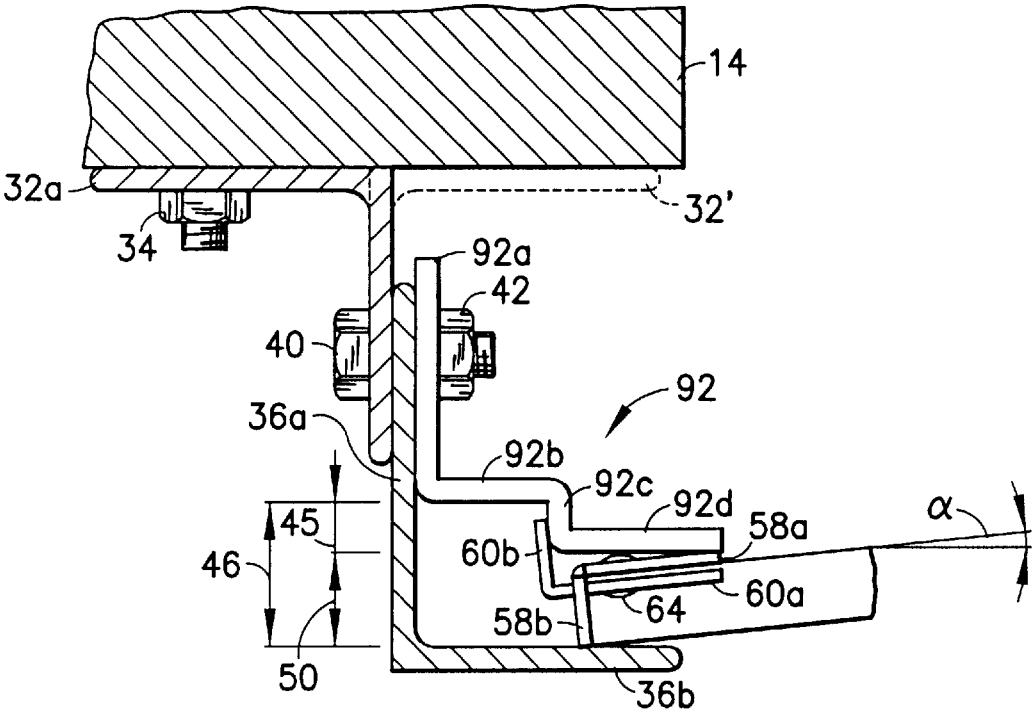
FIG. 7 is similar to FIG. 2, but showing a modified design of the guide channel which obviates the need to provide a separate bar which serves as a stop for the wind lock.

Referring to FIG. 7, a modified design of the frame side portion is shown wherein, in place of the angle iron 38, there is provided a formed beam or elongate member 92 which has a first portion secured to the flange portions 32*b*, 36*a*, as in FIG. 2. A spacer portion 92*b* extends normal to the portion 92*a*, a distance substantially corresponding to the distance "s" in FIG. 2. A outwardly directly step 92*c* reduces the width or depth of the guide channel 46 to an opening corresponding to the distance 50 in FIG. 2. With such a modified formed member 92, it is clear that a separate stop 48 need not be provided, but the member 92 serves both to define the dimensions of the guide channel 44 for movements of the edge retainer 56 as well as the stop for the wind lock at the stop 92*c*.

Figure 8:
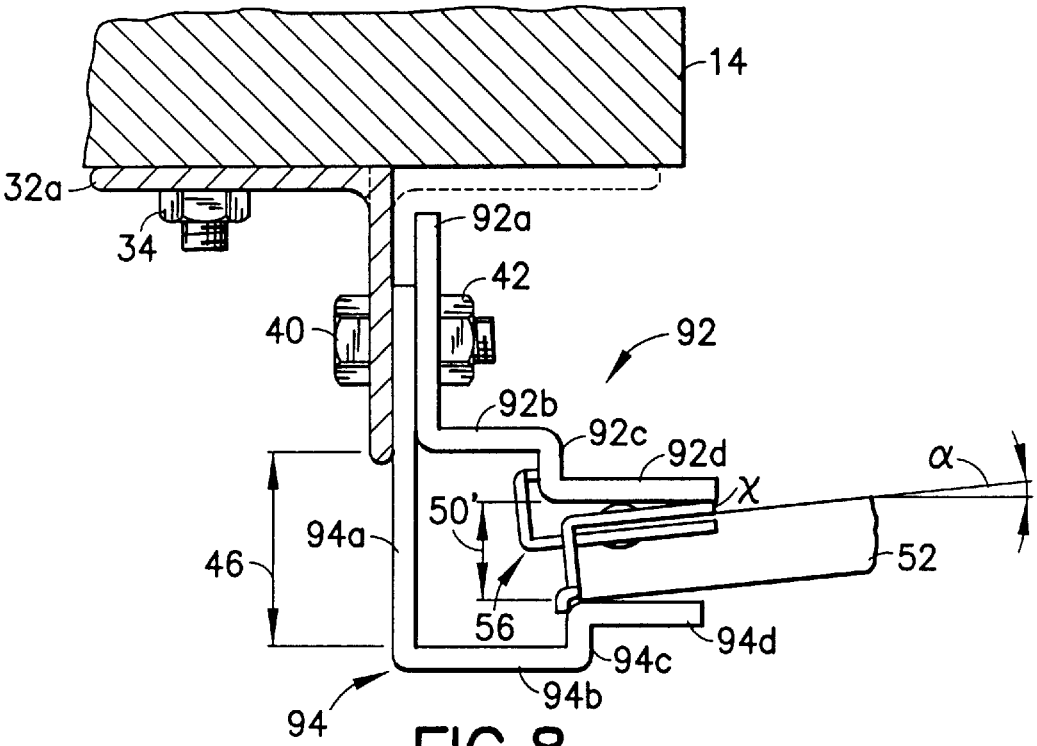
FIG. 8 is similar to FIG. 5, in which each of the elements formed within the guide channel for engaging one or both of the wind lock and end lock are replaced by steps formed in the members defining the guide channel.

FIG. 8 is similar to FIG. 5, with the exception that the angle iron 36 is likewise replaced by a formed member 94 having a portion 94*a* which replaces or is the equivalent of the flange 36*a*. A spacer portion 94*b* projects inwardly, as did the flange portion 36*b*, a distance substantially equal to "s", at which point an inward step 94*c* is provided, beyond which an outer channel 94*d* extends in a direction substantially parallel to the plane of the enclosure. It will be clear, with this construction, that while the guide channel width or depth is still 46, the effective depth or width between the channel portions 92*d* and 94*d* is 50', the dimension similar to the effective opening upon the addition of the supplemental or additional stop 80 in FIG. 5. The embodiment shown in FIG. 8 has the additional advantage that not only does it replace both stops 48 and 80, but it also replaces the pivoting or rotation limiting element 90 of FIG. 6, since it is clear that rotation of the slat 52 to an angle α will cause the edge retainer 56 to engage the inner channel portion 92*d* at point "x", thus effectively limiting further rotation.

Although the present invention has been described in relation to particular embodiments thereof, many other variations, modifications and other uses will become apparent to those skilled in the art. It is the intention, therefore, that the present invention not be limited by the specific disclosure of the embodiments therein, but only by the scope of the appended claims.

What I claim is:

1. An edge retainer adapted to be secured to a slat of an overhead rolling door formed of a plurality of elongate substantially horizontal slats each defining a slat plane and having two opposing substantially parallel longitudinal edges and a lateral edge at each longitudinal end, adjacent slats being hingedly interlocked at their longitudinal edges to enable the door to assume a rolled condition when the door is open and a substantially planar condition when the door is closed, the retainer comprising first and second members having mounting portions for bridging a lateral edge of a slat and for being secured to opposite surfaces of the slat to receive at least a portion of a lateral edge sandwiched therebetween, and an end lock integrally formed with one of said mounting portions for extending from one side of the slat plane to the other side thereof, a wind lock integrally formed with the other of said mounting portions and extending from said other side of said slat plane to said one side thereof, whereby longitudinally outwardly directed forces on at least one of said windlock and end lock promotes said mounting portions to press against and grip a sandwiched portion of a lateral edge of the slat between said mounting portions.

2. Edge retainer as defined in claim 1, wherein said end lock forms an angle substantially normal to its associated mounting portion.

3. Edge retainer as defined in claim 1, wherein said wind lock forms an angle substantially normal to its associated mounting portion.

4. Edge retainer as defined in claim 1, wherein said end lock has a generally central dimensioned to receive an associated wind lock therethrough.

5. Edge retainer as defined in claim 1, wherein said mounting portions have opposing facing areas that are substantially equal.

6. Edge retainer as defined in claim 1, wherein said mounting portions have opposing facing areas one of which is greater than the other.

7. Edge retainer as defined in claim 6, wherein said mounting portion associated with said end lock has an area which is greater than that of said mounting portion associated with said wind lock.

8. Edge retainer as defined in claim 7, wherein said end lock has a central slot having a predetermined length dimensioned to receive said wind lock therethrough, said mounting portion associated with said wind lock being provided with lateral protuberances having a dimension greater than said predetermined length to limit relative movements and to align said mounting portions in desired aligned positions.

9. Edge retainer as defined in claim 1, further comprising fastener means for securing said mounting portions to an associated slat engaged with the retainer.

10. Edge retainer as defined in claim 9, wherein said fastener means comprises at least one rivet that extends through both said mounting portions.

11. Edge retainer as defined in claim 1, wherein at least one of said end lock and wind lock is provided with a hook portion at a free edge thereof.

12. In a wind-resistant overhead closure for a generally rectangular opening in a wall of a building structure, comprising a frame dimensioned to conform to the wall opening and including an upper horizontal portion and spaced vertical side portions, a rolling door extending between said side portions and having a plurality of elongate substantially horizontal slats each defining a slat plane and having two opposing substantially parallel longitudinal edges and a lateral edge at each longitudinal end, adjacent slats being hingedly interlocked at their longitudinal edges to enable the door to assume a rolled condition when the door is open and a substantially planar condition when the door is closed; and edge retainers mounted on selected slats and cooperating with associated side portions, each retainer comprising first and second members having mounting portions bridging a lateral edge of a slat and being secured to opposite surfaces of the slat to receive at least a portion of a lateral sandwiched edge therebetween, and an end lock integrally formed with one of said mounting portions and extending from one side of the slat plane to the other side thereof, a wind lock integrally formed with the other of said mounting portions and extending from said other side of said slat plane to said one side thereof, whereof longitudinally outwardly directed forces on at least one of said windlock and end lock promote said mounting portions to press against and grip sandwiched portions of said lateral edges of the slats between said mounting positions.

13. In a wind-resistant overhead closure as defined in claim 12, wherein said end lock forms an angle substantially normal to its associated mounting portion.

14. In a wind-resistant overhead closure as defined in claim 12, wherein said wind lock forms an angle substantially normal to its associated mounting portion.

15. In a wind-resistant overhead closure as defined in claim 12, wherein said end lock has a generally central slot dimensioned to receive an associated wind lock therethrough.

16. In a wind-resistant overhead closure as defined in claim 12, wherein said mounting portions have opposing facing areas that are substantially equal.

17. In a wind-resistant overhead closure as defined in claim 12, wherein said mounting portions have opposing facing areas one of which is greater than the other.

18. In a wind-resistant overhead closure as defined in claim 17, wherein said mounting portion associated with said end lock has an area which is greater than that of said mounting portion associated with said wind lock.

19. In a wind-resistant overhead closure as defined in claim 18, wherein said end lock has a central slot having a predetermined length dimensioned to receive said wind lock therethrough, said mounting portion associated with said wind lock being provided with lateral protuberances having a dimension greater than said predetermined length to limit relative movements and to align said mounting portions in desired aligned positions.

20. In a wind-resistant overhead closure as defined in claim 12, further comprising fastener means for securing said mounting portions to an associated slat engaged with the retainer.

21. In a wind-resistant overhead closure as defined in claim 20, wherein said fastener means comprises at least one rivet that extends through both said mounting portions.

22. In a wind-resistant overhead closure as defined in claim 12, wherein at least one of said end lock and wind lock being provided with a hook portion at a free edge thereof most remote from said slat plane.

23. In a wind-resistant overhead closure as defined in claim 12, wherein each vertical side portion defines a substantially vertical guide channel having a vertical slotted opening facing the other of said side portions and dimensioned to receive and permit free vertical movements of said slats therein with clearance, and stop means associated with each guide channel for capturing the edge retainer and limiting excessive lateral movements of said edge retainer and lateral end of said slat to which it is attached during flexing or deformation thereof under wind load.

24. In a wind-resistant overhead closure as defined in claim 23, wherein each vertical guide channel comprises a larger edge retainer receiving portion beyond the lateral edges of said slats and a smaller receiving portion which forms said vertical slotted opening.

25. In a wind-resistant overhead closure as defined in claim 24, wherein said smaller edge retainer receiving portion is formed by a protuberance within said larger edge retainer receiving portion.

26. In a wind-resistant overhead closure as defined in claim 25, wherein said protuberance comprises at least one vertical bar in each vertical side portion.

27. In a wind-resistant overhead closure as defined in claim 26, wherein said protuberance comprises a vertical bar on each side of said slats received within each guide channel.

28. In a wind-resistant overhead closure as defined in claim 25, wherein said protuberance comprises at least one inwardly projecting step formed on each vertical side portions which reduces the spacing of each guide channel along a direction substantially normal to a plane defined by said spaced vertical side portions.

29. In a wind-resistant overhead closure as defined in claim 28, wherein said protuberance comprises two inwardly projecting steps formed on each side of said slats received within each guide channel.

30. In a wind-resistant overhead closure as defined in claim 23, further comprising pivoting limiting means for preventing the pivoting or rotation of an edge retainer within a guide channel about an axis substantially parallel to said vertical side portions after said edge retainer has engaged said stop means.

* * * * *